US006595463B2

(12) United States Patent
Miyazaki

(10) Patent No.: US 6,595,463 B2
(45) Date of Patent: Jul. 22, 2003

(54) LARGE PRINTER

(75) Inventor: Kenichi Miyazaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/769,268

(22) Filed: Jan. 26, 2001

(65) Prior Publication Data

US 2001/0007227 A1 Jul. 12, 2001

Related U.S. Application Data

(62) Division of application No. 09/386,000, filed on Aug. 30, 1999.

(30) Foreign Application Priority Data

Aug. 31, 1998 (JP) ..... P10-246035
Aug. 31, 1998 (JP) ..... P10-246039

(51) Int. Cl.[7] ..... B65H 16/02
(52) U.S. Cl. ..... 242/598.2; 242/594.5; 242/598.3
(58) Field of Search ..... 242/594.5, 594.6, 242/598.2, 598.3, 599.3, 598.4

(56) References Cited

U.S. PATENT DOCUMENTS

| | | | | | |
|---|---|---|---|---|---|
| 731,123 | A | * | 6/1903 | Owen | 242/598.4 |
| 810,606 | A | * | 1/1906 | Ball | 242/598.2 |
| 938,885 | A | | 11/1909 | McCulley | |
| 1,128,730 | A | | 2/1915 | Smedal | |
| 2,595,055 | A | * | 4/1952 | Clark et al. | 242/598.2 |
| 3,151,551 | A | * | 10/1964 | Dutro et al. | 242/598.3 |
| 4,339,093 | A | * | 7/1982 | Shanklin et al. | 242/598.3 |
| 5,042,272 | A | * | 8/1991 | Furr | 242/598.2 |
| 5,072,306 | A | | 12/1991 | Matsumoto et al. | 358/304 |
| 5,187,532 | A | | 2/1993 | McNew | 399/384 |
| 5,229,827 | A | | 7/1993 | Sato et al. | |
| 5,237,378 | A | | 8/1993 | McEwen | 399/21 |
| 5,302,037 | A | | 4/1994 | Schoendienst et al. | 400/586 |
| 5,315,404 | A | | 5/1994 | Kuboki et al. | 358/433 |
| 5,374,007 | A | * | 12/1994 | Murison | 242/598.3 |
| 5,590,435 | A | | 1/1997 | Kostigian | 15/40 |
| 5,653,293 | A | * | 8/1997 | Ellis | 242/598.2 |
| 5,690,774 | A | | 11/1997 | Greene | |
| 5,838,354 | A | | 11/1998 | Yamada et al. | 347/101 |
| 5,911,382 | A | | 6/1999 | Wilson | 242/419.6 |
| 5,963,216 | A | | 10/1999 | Chiarabini et al. | 345/439 |
| 6,106,623 | A | | 8/2000 | Nishikawa | |

FOREIGN PATENT DOCUMENTS

| | | | |
|---|---|---|---|
| EP | 750994 | 1/1997 | B41J/2/195 |
| EP | 0 805 042 A2 | 5/1997 | |
| JP | 2-59372 | 2/1990 | B41J/13/00 |

OTHER PUBLICATIONS

Patent Abstracts of Japan, vol. 014, No. 231, May 16, 1990 & JP 02 059372 (Canon Inc.).

Patent Abstracts of Japan, vol. 1998, No. 05, Apr. 30, 1998 & JP 10 016329 (Brother Ind. Ltd.).

* cited by examiner

*Primary Examiner*—John M. Jillions
(74) *Attorney, Agent, or Firm*—Sughrue Mion, PLLC

(57) ABSTRACT

A large printer comprises a paper feeding unit in which at least one roll of paper and at least one sheet of paper including a stiff carton to be supplied are loaded, the paper feeding unit being located at a height that enables a user standing in front of the printer to execute the paper feeding process including replacement of the roll paper and setting the sheet of paper. A printing unit is located below the paper feeding unit. A discharged paper stacking unit is located below the printing unit. A paper feeding path extends from the paper feeding unit to the discharged paper stacking unit via the printing unit so as to be substantially straight. The feeding unit includes at least a pair of spindle receptacles into which both ends of an elongated spindle, on which a paper roll is mounted, are inserted. At least one of the spindle receptacles is rotatable, and one end of the spindle can be inserted into the rotatable spindle receptacle in order to insert the other end of the spindle into the other spindle receptacle by rotating the spindle so as to pivot on the rotatable spindle receptacle.

18 Claims, 6 Drawing Sheets

LARGE PRINTER

This is a divisional of application Ser. No. 09/386,000 (Confrimation No. Yet Assigned) filed Aug. 30, 1999, the disclosure of which is incorporated herein by reference.

Priority is claimed from Aug. 31, 1998 based on Japanese Application Nos. 10-246035, and 10-246039, respectively. The priority document(s) were filed in parent application Ser. No. 09/386,000.

BACKGROUND OF THE INVENTION

The present invention relates to a large printer that employs roll paper, and in particular to a large printer that can print a large sheet of paper having a width of 420 mm or more.

Most related large printers that use roll paper are so designed that the paper feeding path runs from the rear to the front, and paper rolls are located at the rear of the main printer bodies. Therefore, to replace a paper roll for one of these printers a user must be positioned behind it, and as a result the required installation space is increased in the direction of the depth.

There are some printer designs that provide for a paper roll to be located in the front of the printer main body, but since sheets are discharged to the front along U-shaped feeding paths, the path structures are complicated, and becomes more complicated when a plurality of paper rolls are set up for use.

One printer, though it is not a large printer that uses roll paper, is provided wherein, in order to reduce the installation space of the printer main body in the direction of depth, a paper feeding path in a subscanning direction, including a paper supply portion from which a sheet of paper is supplied and a paper ejection portion from which the sheet is ejected, is arranged so as to be substantially straight in the diagonal direction of a casing that constitutes a dark box. This printer is disclosed in Japanese Patent Publication No. 2-59372A.

Paper rolls for large printers are correspondingly large, and quite heavy. In the related art, however, no printer that uses such roll paper is considered or taught that permits a user to replace a heavy paper roll from the front of the printer while standing, and without bending at the waist. Further, in the related art, no printer which uses such roll paper is taught that can print also large sheets of stiff carton.

In a large printer using roll paper, a spindle on which a paper roll is mounted is held by a pair of spindle receptacles provided in the printer main body. When a paper roll is exhausted, a new one is mounted in its place. For a related large printer, the positions for the spindle receptacle pair are fixed, i.e., the spindle receptacles are located opposite each other, regardless of whether a spindle is mounted or not.

However, because a paper roll for a large printer is also large, accordingly, the spindle for the paper roll is quite heavy. And as is described above, since a related large printer has a fixed structure wherein spindle receptacles are located opposite each other, when replacing a spindle mounted paper roll, a user must hold the large, heavy spindle with both hands while stretching out both arms and inserting the ends of the spindle into the receptacles. As a result, a large load is imposed on the user's arms, and the changing of a paper roll involves a great deal of labor.

SUMMARY OF THE INVENTION

In view of the above, it is therefore a first object of the present invention to provide a large printer using a large, heavy paper roll, which a user, while standing and without bending at the waist, can replace from the front of the printer, with which a user can print also large sheets of stiff carton.

It is a second objective of the present invention to provide a large printer, in which spindle receptacles can be easily engaged by a spindle on which a large, heavy paper roll is mounted, for which the loading of a new paper roll imposes only a small load on a user.

To achieve the above objectives, there is provided a large printer comprising: a paper feeding unit in which at least one roll of paper and at least one sheet of paper including a stiff carton to be supplied are loaded, the paper feeding unit being located at a height that enables a user standing in front of the printer to execute the paper feeding process including replacement of the roll paper and setting the sheet of paper; a printing unit located below the paper feeding unit; a discharged paper stacking unit located below the printing unit; and a paper feeding path extending from the paper feeding unit to the discharged paper stacking unit via the printing unit so as to be substantially straight.

According to the configuration, the feeding unit in which roll paper is loaded is located at a height at which a user standing in front of the printer can replace a paper roll. Thus, to replace a heavy paper roll, a user does not have to bend from the waist nor move behind the printer, and the replacement can be easily and quickly performed. Further, without bending at the waist a user can easily set up the sheet of paper, such as the stiff carton, on the printer.

In the printer, a plurality of paper rolls are detachably loaded in the paper feeding unit such that the plural paper rolls are arranged obliquely with each other in the vertical direction. Accordingly, when one roll of paper is exhausted, it can be quickly replaced by a new paper roll. If the upper paper roll is used first, by switching from the upper to the lower paper roll a replacement for the upper paper roll can be loaded while the printing is continued.

In the printer, the paper feeding unit includes a cover member for covering the loaded paper roll from thereabove and for covering the paper roll and for supporting the supplied stiff carton from therebelow. When a large sheet of stiff carton is supported at only one end, the free end tends to be bent down by its own weight, and overall deformation of the paper occurs. However, the cover member located upstream of the printing unit also serves as a support and prevents the large sheet of stiff carton from being deformed by its own weight. Thus, when stiff carton is used it can be held horizontal, and deterioration of the print quality of printed matter can be prevented.

In the printer, the feeding unit includes at least a pair of spindle receptacles into which both ends of an elongated spindle, on which a paper roll is mounted, are inserted. At least one of the spindle receptacles is rotatable, and one end of the spindle can be inserted into the rotatable spindle receptacle in order to insert the other end of the spindle into the other spindle receptacle by rotating the spindle so as to pivot on the rotatable spindle receptacle.

With this arrangement, since at first only one end of a spindle need be inserted into a receptacle, and since a rotatable spindle receptacle can be moved in a direction that enables the spindle to be inserted into another receptacle, a user can easily set up the spindle without having to stretch out both arms, as in the related art. Further, after one end of the spindle has been inserted into the rotatable spindle receptacle, half of the total weight is supported by the receptacle and the imposed load is reduced. And in addition, since only the rotatable spindle receptacle need be pivoted on the support point in order to insert the other end of the spindle into the other spindle receptacle, the replacement of a paper roll is extremely easy.

In the printer, the paper feeding path extends straight from an upper rear portion of the printer to a lower front portion thereof. Alternatively, the paper feeding path may extend perpendicular to the upper rear portion. With this arrangement, a user can replace a heavy paper roll, while standing and without bending at the waist, and without moving to the back of the printer. Further, a user can set up also a large sheet of stiff carton, on the paper feeding unit at the front of the printer, without bending at the waist.

According to the present invention, there is also provided a large printer using at least one roll of paper comprising: at least one pair of spindle receptacles into which both ends of an elongated spindle, on which a paper roll is mounted, are inserted. At least one of the spindle receptacles is rotatable, and one end of the spindle can be inserted into the rotatable spindle receptacle in order to insert the other end of the spindle into the other spindle receptacle by rotating the spindle so as to pivot on the rotatable spindle receptacle.

With this arrangement, since at first only one end of a spindle must be inserted into a receptacle, and since a rotatable spindle receptacle can be moved in a direction that enables the spindle to be inserted into another receptacle, a user can easily set up the spindle without having to stretch out both arms, as in the related art. Further, after one end of the spindle has been inserted into the rotatable spindle receptacle, half of the total weight is supported by the receptacle and the imposed load is reduced. And in addition, since only the rotatable spindle receptacle need be pivoted on the support point in order to insert the other end of the spindle into the other spindle receptacle, the replacement of a paper roll is extremely easy.

In the printer, the rotation of the rotatable spindle receptacle toward the front of the printer is limited to an angle ranging from 20 to 50 degrees. Thus, from the front of the printer one end of a spindle can be inserted at an appropriate angle for which a large work space depth is not required. In this case, a range of from 30 to 40 degrees is more preferable.

In the printer, the rotatable spindle receptacle is so urged by urging means as to rotate automatically toward front of the printer for a rotation limit thereof when the spindle is removed. Thus, when to change a paper roll the spindle is removed from the spindle receptacles, the rotatable spindle receptacle is automatically pivoted to the front at an appropriate angle. As a result, when a new paper roll is being loaded the direction of the rotatable spindle receptacle need not be manually adjusted to insert one end of a spindle thereto.

In the printer, at least two pairs of the spindle receptacles are arranged obliquely with each other in the vertical direction. Therefore, when the paper in one roll is exhausted, it can be immediately replaced by the other one. If the upper paper roll is used first, the upper paper roll can be replaced by a new one while printing is continued by switching to the lower paper roll.

In the printer, a stopper is formed on one end of the spindle, and an engagement portion with which the stopper is engaged is formed in the rotatable spindle receptacle. Since the stopper engages the engagement portion when that end of the spindle is inserted into the spindle receptacle, the spindle will not be removed from the spindle receptacle by mistake during the replacement of a paper roll.

In the printer, the end of the spindle at which the stopper is formed differs in appearance from the other end for preventing the insertion of the wrong end of the spindle. Simply by glancing at the ends of the spindle a user can identify the end that is to be inserted first in addition to its original function.

According to the present invention, there is also provided a large printer comprising: a sheet feeding area positioned at a height whereat a user standing in front of the printer is able to set up a printing medium.

In the printer, a plurality of paper rolls are loaded in the sheet feeding area so as to be arranged obliquely with each other in the vertical direction.

In the printer, the printing medium includes at least one roll of paper and at least one sheet of stiff carton. The sheet feeding area includes an accommodation space in which the paper roll is loaded and a cover member for covering the accommodation space from thereabove and for supporting the stiff carton from therebelow.

The printer further comprises: an elongative member disposed in the paper feeding area for holding the printing medium; and a pair of support members for supporting both ends of the elongative member, at least one of the support members being rotatable.

The printer further comprises: a printing area; a paper discharge area; and a paper feeding path extending from the paper feeding area to the paper discharge area via the printing area. The paper feeding area is located in an upper rear portion of the printer and the paper discharge area is located in a lower front portion of the printer. Alternatively, the paper feeding path may be extended from the paper feeding area to the paper discharge area via the printing area perpendicularly.

According to the present invention, there is also provided a large printer for printing on paper supplied from a paper roll, comprising: an elongative member for supporting the paper roll; and a pair of support members for supporting both ends of the elongative member, at least one of the support members being rotatable.

In the printer, the rotation of the rotatable support member toward the front of the printer is limited to an angle ranging from 20 to 50 degrees.

In the printer, the rotatable support member is so urged by urging means as to rotate automatically toward front of the printer for a rotation limit thereof when the spindle is removed.

In the printer, at least two pairs of the spindle receptacles are arranged obliquely with each other in the vertical direction.

In the printer, a stopper is formed on one end of the spindle, and an engagement portion with which the stopper is engaged is formed in the rotatable spindle receptacle.

In the printer, the end of the spindle at which the stopper is formed differs in appearance from the other end for preventing the insertion of the wrong end of the spindle.

DETAILED DESCRIPTION OF THE PREFERRED EMBODIMENTS

The preferred embodiment of the present invention will now be described while referring to the accompanying drawings. In the present invention, a large printer can print a large sheet of paper having a width of 420 mm or greater. Of course, the large printer includes a print head that can also print paper having a width less than 420 mm. In the large printer specifically described below, a paper feeding unit can accept, as a printing medium, a paper roll having a width of about 210 mm to 1120 mm and a diameter of 10 cm to 15 cm, or a sheet of paper having approximately the same width as the roll paper, and a length of about 420 mm to 1580 mm (for paper having a thickness of less than 0.5 mm) or of about 420 mm to 730 mm (for stiff carton having a thickness of 0.5 mm to 1.5 mm).

Figure 1:
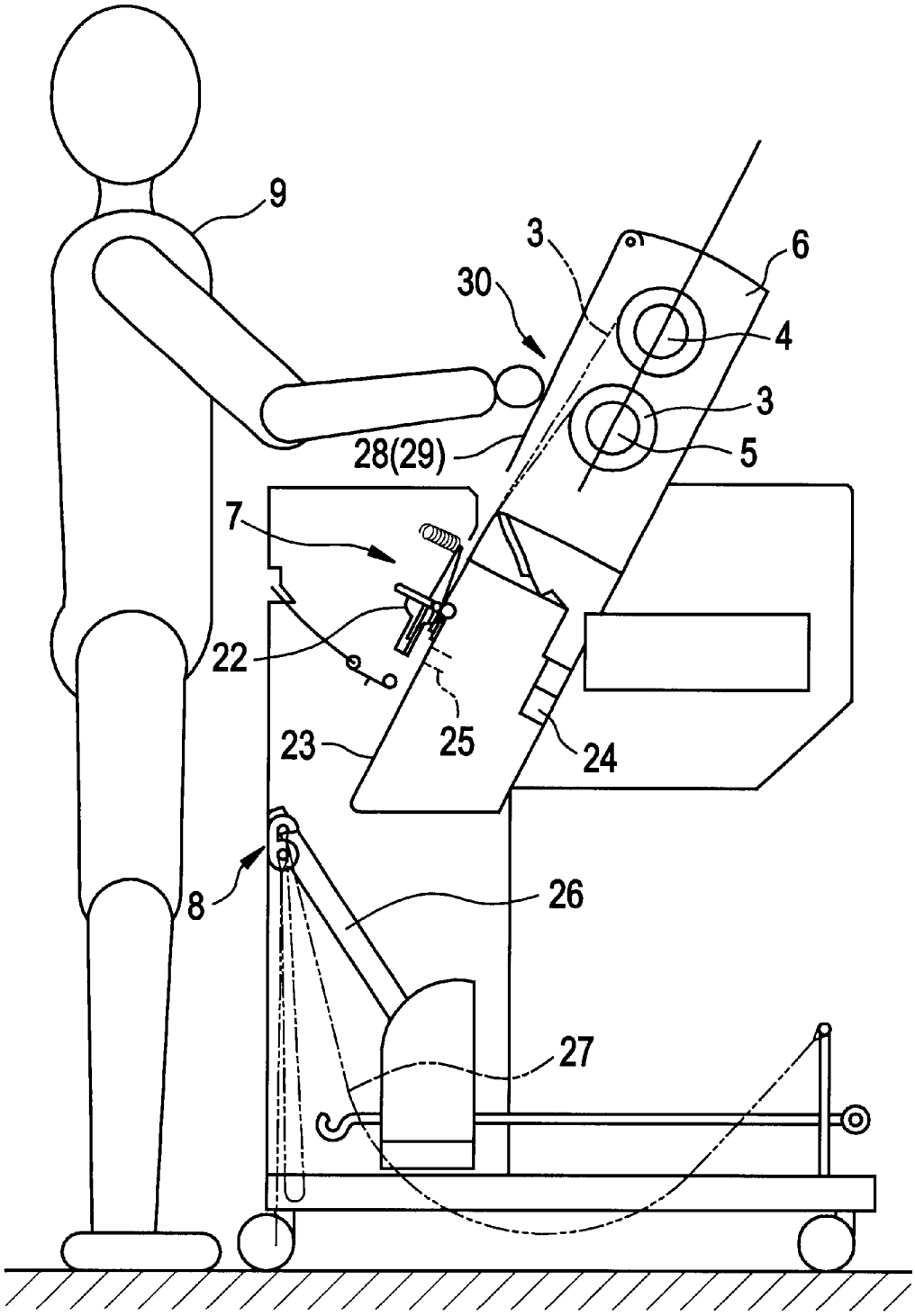
FIG. 1 is a schematic vertical section view showing a state wherein a user replaces a paper roll for a large printer according to the present invention.
Figure 3:
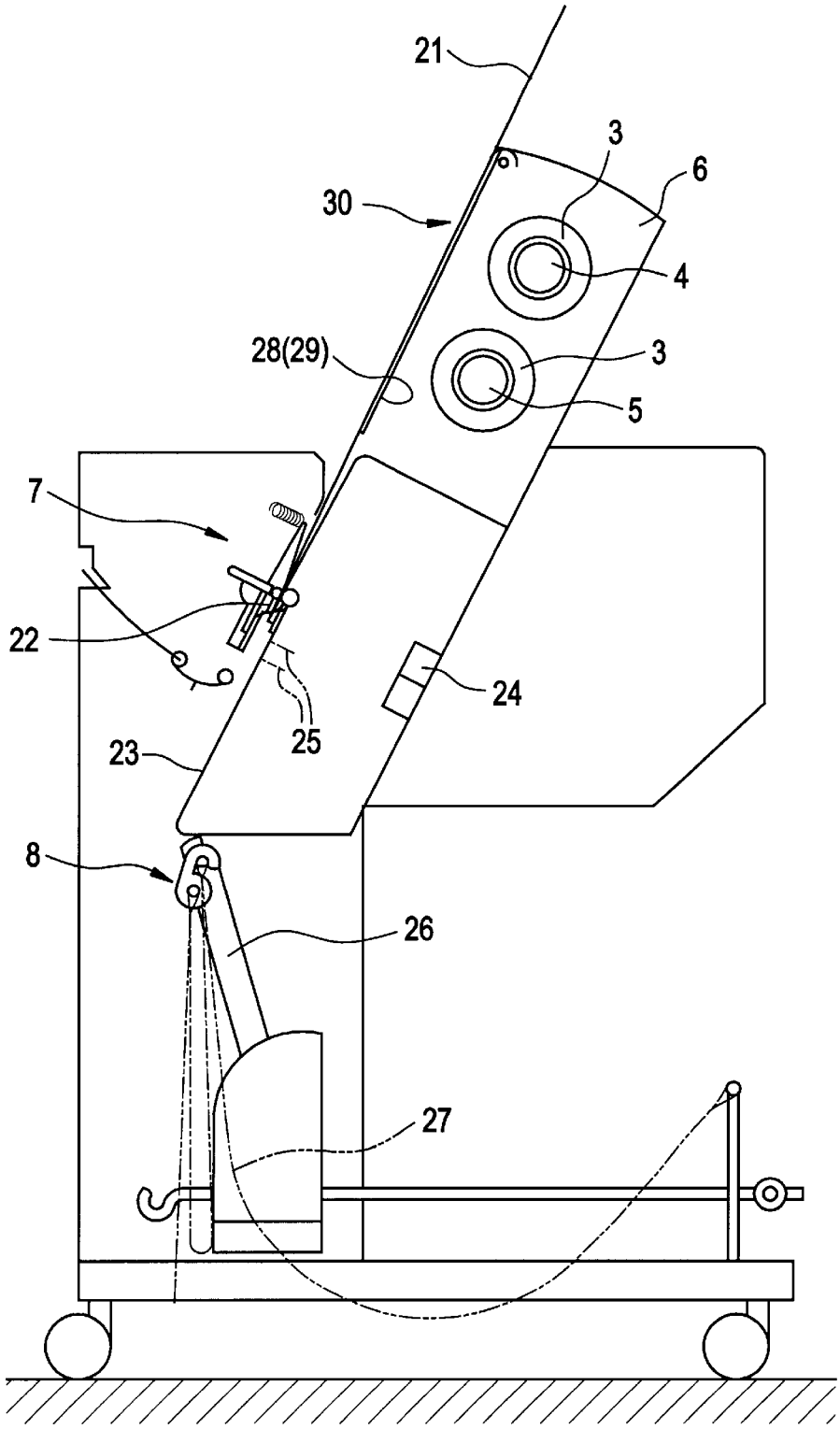
FIG. 3 is a schematic side view of the state wherein stiff carton is printed by the large printer.

As is shown in FIG. 1, a large printer according to the embodiment comprises a paper feeding unit 30, a printing unit 7, and a discharged paper stacking unit 8, which are located at the top, middle and bottom positions, respectively. The external dimensions of the large printer are height: 1259 mm; width: 1688 mm; and width: 699 mm. The paper feeding path extending from the paper feeding unit 30 situated in upper rear portion of the main body to the discharged paper stacking unit 8 situated in lower front portion of the main body via the printing unit 7 is arranged so as to be substantially straight. The paper feeding unit 30 can feed both roll paper 3 and large sheets of stiff carton 21 (see FIG. 3). Specifically, paper rolls can be detachably loaded in the paper feeding unit 30 so that they can be removed and replaced, and the stiff carton 21 can be mounted along the slope at the front face of the paper feeding unit 30, as is shown in FIG. 3.

In the printing unit 7, a flat paper discharge guide 23, which is a part of the paper feeding path, is located below a print head 22, and a suction port 25, which communicates with a suction fan 24, is provided for the paper discharge guide 23. The force produced by suction is employed to draw the paper to the suction port 25 and to thereby control the delivery state, and the discharged paper stacking unit 8 is provided to accept printer paper. When roll paper 3 is printed, a stack cloth 27 is moved to the front of the printer by a discharged paper switch lever 26, and the printer matter is guided to the lower portion of the printer main body in the state depicted in FIG. 1. When the stiff carton 21 is printed, however, as is shown in FIG. 3 the stacking unit 8 is retracted by the lever 26 to a position where it does not prevent the discharge of the stiff carton 21.

Further, as is shown in FIG. 1, the paper feeding unit 30 is located at a height whereat a user 9 can perform a paper feeding process, including the replacement of paper rolls 3 and the setting up of stiff carton 21. In this embodiment, the height of a user who is 1170 cm tall is used to determine the height of the paper feeding unit 30. If the height of the paper feeding unit 30 can be adjusted, it can be set to provide an optimal height for an individual user. Furthermore, a paper feeding process, such as the replacement of a paper roll 3, can be performed from the front of the large printer (the side whereat the user is located in FIG. 1).

Figure 2:
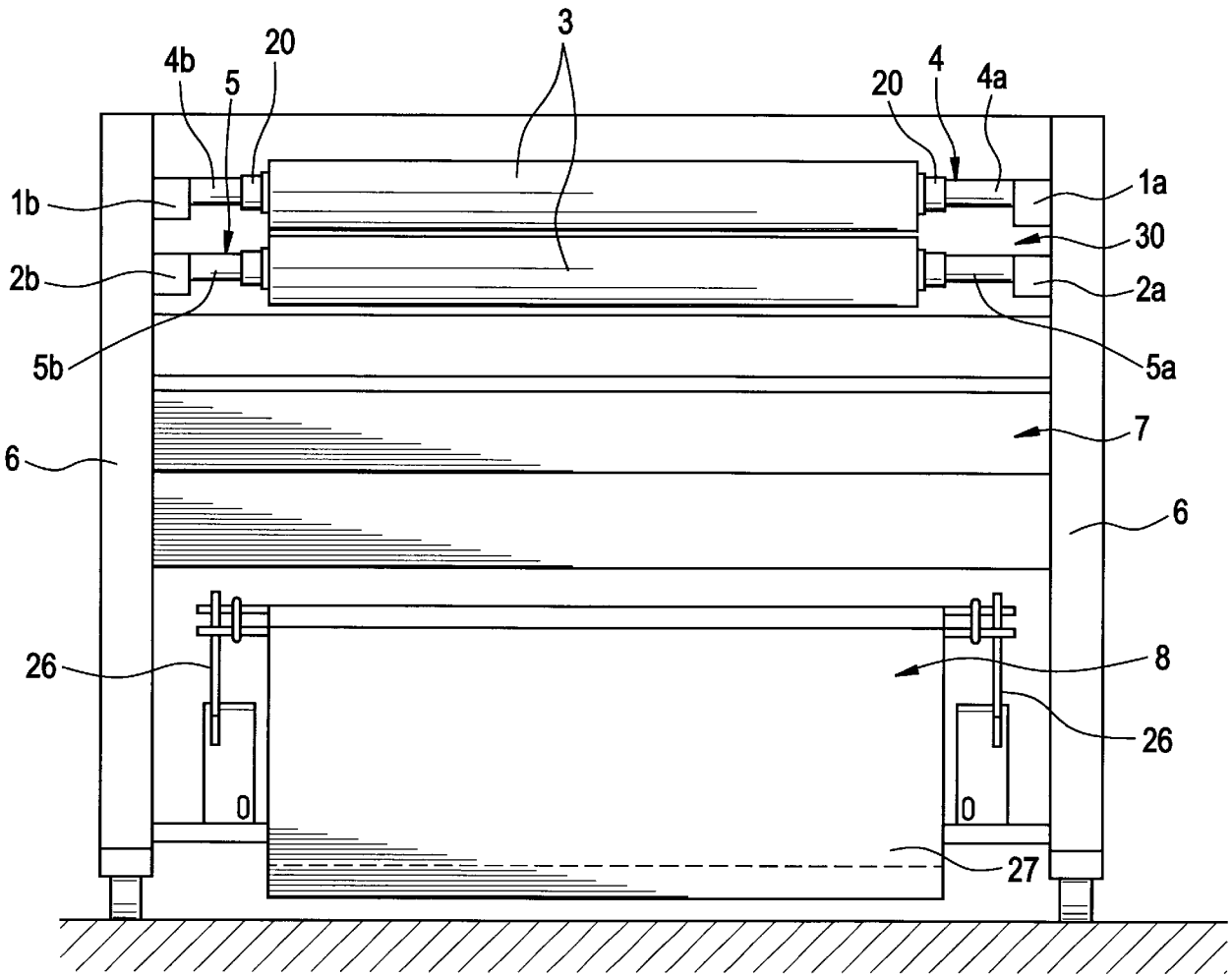
FIG. 2 is a schematic front view of the large printer.

FIG. 2 is a schematic front view of the large printer according to the embodiment, and a paper roll cover 28 (described later) is not shown. A pair of spindle receptacles 1*a* and 1*b* and a second pair of spindle receptacles 2*a* and 2*b* underneath are provided for the paper feeding unit 30 of the large printer. Elongated spindles 4 and 5, on which the paper rolls 3 are respectively mounted, horizontally lie between the spindle receptacles 1*a* and 1*b*, and 2*a* and 2*b*. That is, ends 4*a* and 4*b* of the spindle 4 are inserted into the spindle receptacles 1*a* and 1*b*, and ends 5*a* and 5*b* of the spindle 5 are inserted into the spindle receptacles 2*a* and 2*b*. In FIG. 2, the spindle receptacles 1*a* and 1*b*, and 2*a* and 2*b* are attached to the frame 6 of the printer main body.

As is shown in FIG. 1, the two spindles 4 and 5 are positioned at an oblique angle, so that relative to the user 9 the upper spindle 4 is at the rear. The paper roll 3 is so located that paper is delivered along the substantially straight paper feeding path that extends obliquely upward from the printing unit 7, and downward port for the discharged upper stacking unit 8.

As is shown in FIG. 3, the stiff carton 21 can set up by mounting it on the slope at the front of the paper feeding unit 30. In this embodiment, in the paper feeding unit 30, the paper roll cover 28 is provided in front of the loaded paper roll 3, i.e., in front of the area whereat the paper roll 3 is located, and serves as a supporting portion 29 when a sheet of the stiff carton 21 is set up. The paper roll cover 28 is opened or closed by rotating the free end thereof so as to pivot on the upper end thereof. When the paper roll cover 28 is closed, it can serve as a part of the paper feeding path used for printing a sheet of paper, such as a sheet of the stiff carton 21.

The structures of the spindle receptacles 1*a* and 1*b*, which are the essential components of the large printer of the present invention, will now be described while referring to FIG. 5. Since the other spindle receptacles 2*a* and 2*b* are the same as the spindle receptacles 1*a* and 1*b*, explanation of the other spindle receptacles 2*a* and 2*b* will be omitted. The spindle receptacle 1*a* is formed so that it can be rotated along the horizontal plane. And in this embodiment, a rotary portion 11 is provided for abase 10 fixed to the frame 6 so that it can be pivoted on a support point 12. In the rotary portion 11 is a recess 13 into which the end 4*a* of the spindle 4 is inserted. A pair of rollers 14, which are symmetrically positioned at the bottom of the recess 13 with the support point 12 therebetween, are provided to reduce the rotation load of the spindle 4.

In the embodiment, the rotation of the rotary portion 11 to the front of the printer is limited to an angle of from 20 to 50 degrees. Preferably, the rotation is limited to a range of from 30 to 40 degrees, and in this embodiment, the rotation to the front of the printer is halted at an angle of approximately 35 degrees. In this embodiment, the rotary portion 11 is provided with a spring (not shown) that rotates the rotary portion 11 to the front of the printer. When the spindle 4 is removed from the spindle receptacle 1*a* (the state in FIG. 5), the spring automatically positions the rotary portion 11 at an angle of about 35 degrees, the rotation limit.

Figure 5:
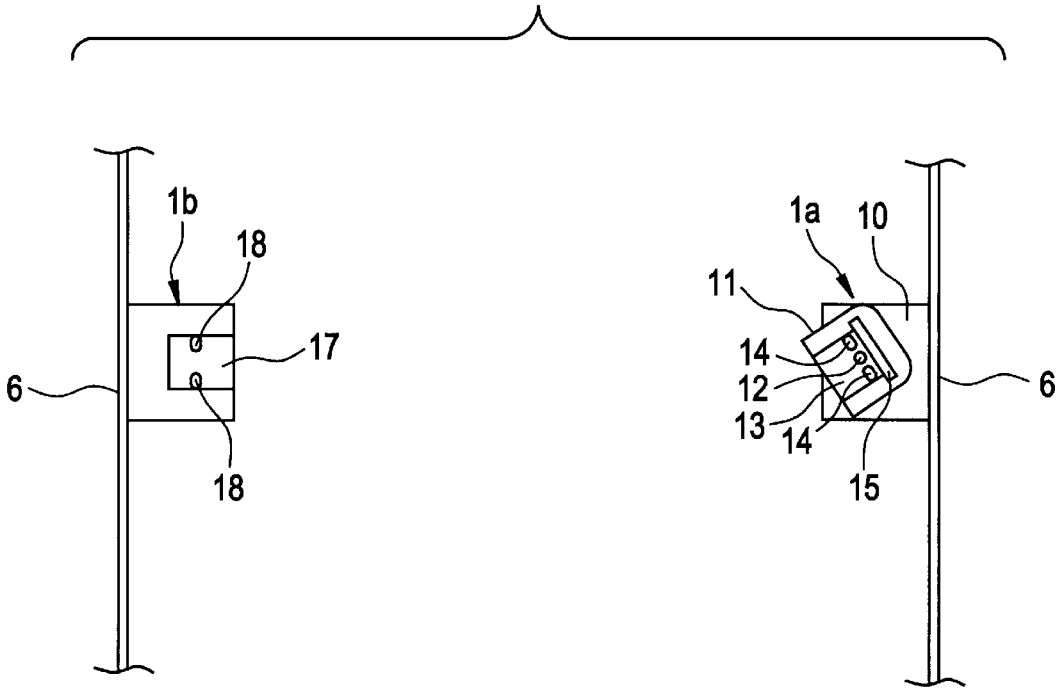
FIG. 5 is an enlarged plan view of a pair of spindle receptacles in the large printer.
Figure 6:
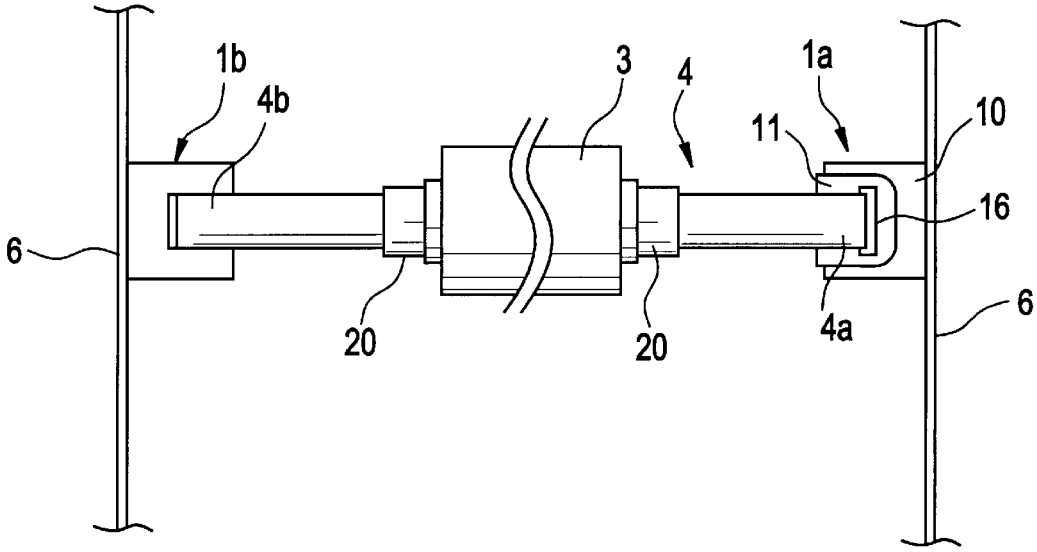
FIG. 6 is a plan view of the state wherein both ends of a spindle have been inserted into the spindle receptacles.

In this embodiment, as is shown in FIG. 5, an engagement portion 15 is provided at the rear of the recess 13, and as is shown in FIG. 6, a stopper 16 is provided at the end 4*a* of the spindle 4. The stopper 16 is formed like an annular flange, and the engagement portion 15 is shaped to fit the flanged stopper 16. However, the engagement portion 15 and the stopper 16 are not limited to the above described shapes.

The structure of the other spindle receptacle 1*b*, into which the other end 4*b* of the spindle 4 is inserted, will now be described while referring to FIG. 5. The spindle receptacle 1*b* is fixed to the frame 6, and has a recess 17 into which the other end 4*b* of the spindle 4 is inserted. A pair of rollers 18 are provided at the bottom of the recess 17, which has a simple shape, and the cylindrical end 4*b* of the spindle 4 is inserted therein.

In this embodiment, the shape of the stopper 16 on the spindle 4 differs from the simple cylindrical shape of the other end, so that the difference in the shape can be recognized at a glance. Therefore, the flanged shape provides an identification function which prevents in advance the erroneous setup of the spindle 4. In FIG. 6, flanges 20 are used to hold the paper roll 3.

Figure 4:
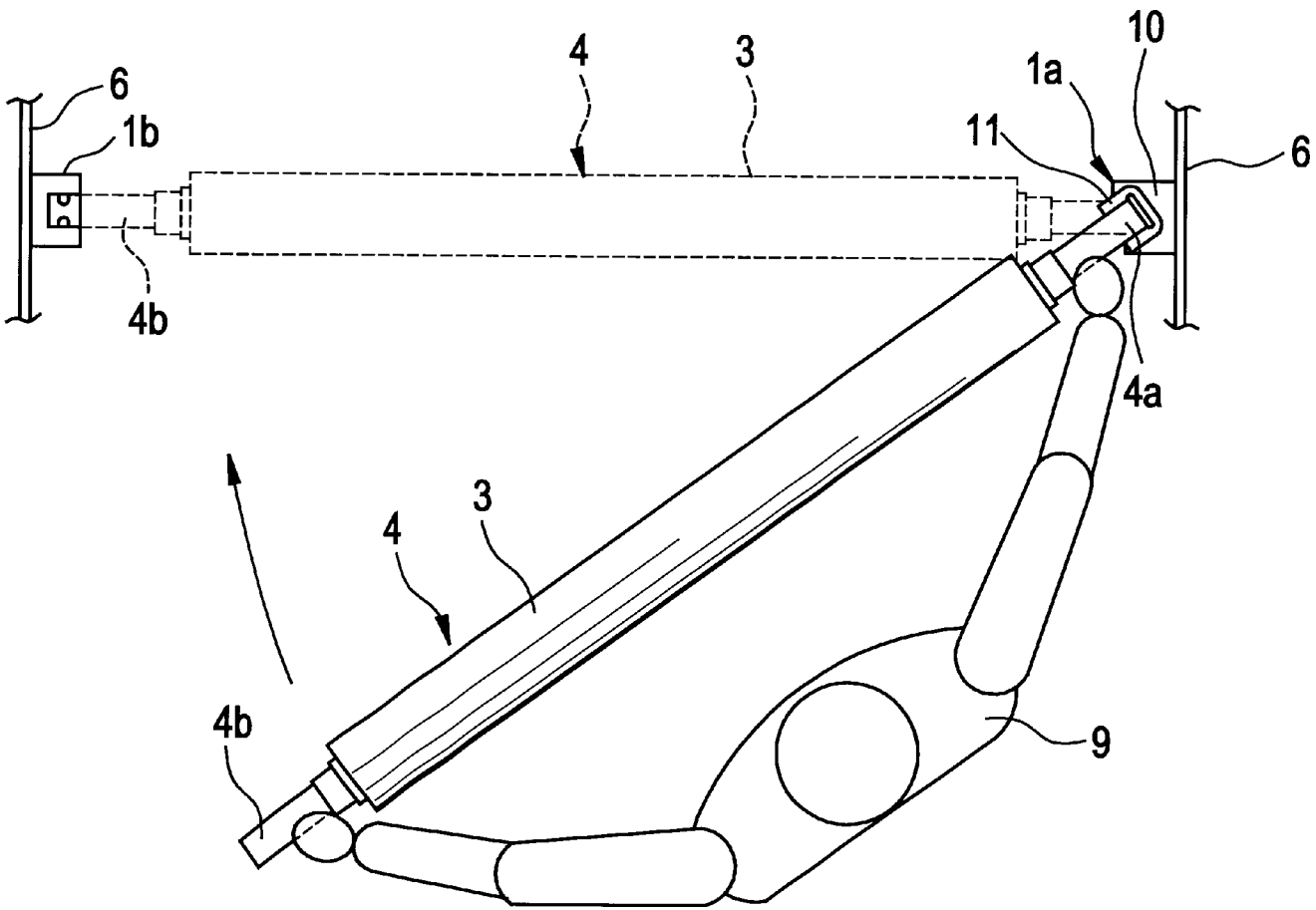
FIG. 4 is a plan view of the essential portion when a paper roll for the large printer is being replaced.
Figure 7:
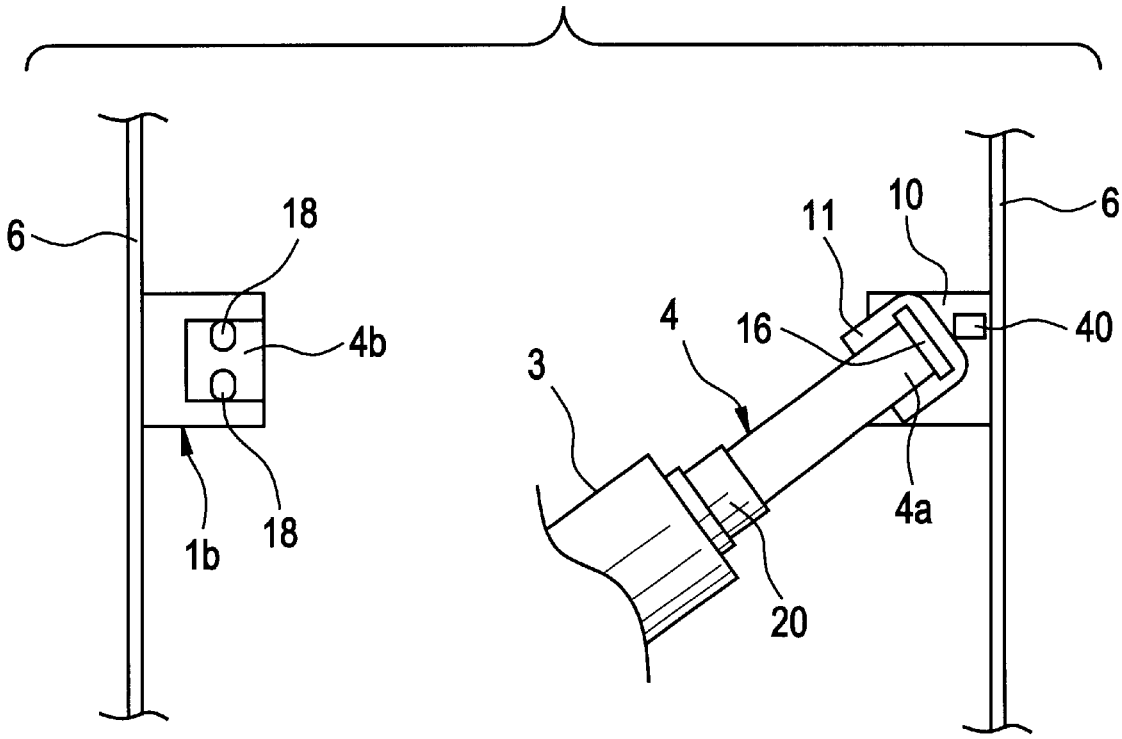
FIG. 7 is a plan view showing a state wherein one end of the spindle has been inserted into a spindle receptacle and before the spindle receptacle has been pivoted.

An explanation will now be given for the paper roll replacement process for a large printer according to the embodiment. First, the user 9, who is standing in front of the printer, lifts and removes the spindle 4 from the pair of spindle receptacles 1*a* and 1*b*, and the spindle receptacle 1*a* is automatically rotated and stopped by the spring (not shown) to the position shown in FIG. 5. Following this, as is shown in FIG. 4, the user 9, who is again standing in front of the printer, inserts into the spindle receptacle 1*a* the right end 4*a* of an elongated spindle 4 on which a new paper roll is mounted. An enlarged view of the thus acquired state is shown in FIG. 7. The user 9, by checking the flange stopper 16, was able to identify which end of the spindle 4 should be inserted first. Then, as is shown in FIG. 4, with the spindle 4 supported by and pivoting on the spindle receptacle 1*a*, the user 9 inserts end 4*b* of the spindle 4 into the spindle receptacle 1*b*. An enlarged view of the final state is shown in FIG. 6.

As is described above, according to the present invention, the paper feeding unit 30, wherein a paper roll 3 is set up, is positioned at a height whereat the user 9, who is standing in front of the printer, can replace the paper roll 3 without having to bend at the waist. According to the present invention the user 9 does not have to move around to the back of the printer, and can easily and quickly perform the replacement process. Also, the user 9, again without bending at the waist, can easily set up a large sheet of stiff carton 21 on the printer.

Further, a plurality of paper rolls 3 are removably mounted in the paper feeding unit 30 at positions located obliquely upward and downward. With this arrangement, when one paper roll is exhausted, it can be quickly replaced by a new one. And if the upper paper roll is used first, by switching from the upper paper roll to the lower paper roll, printing can be continued while the upper paper roll is replaced.

The paper roll cover 28, which is located upstream of the printing unit 7, serves as the supporting portion 29 used to prevent the stiff carton 21 from bending under its own weight. With this arrangement, as is shown in FIG. 3, when a sheet of the stiff carton 21 is loaded it can be held flat and not permitted to bend, and deterioration of the image quality of the printed matter can be prevented.

The end 4*a* of the spindle 4 is inserted into the rotatable spindle receptacle 1*a*, and then the spindle 4 is pivoted on the support point 12 of the rotatable spindle receptacle 1*a* so that the other end 4*b* of the spindle 4 can be inserted into the other spindle receptacle 1*b*. With this arrangement, since the end 4*a* of the spindle 4 must be inserted into the rotatable spindle receptacle 1*a* first, and since the rotatable spindle receptacle 1*a* can be moved in the direction that enables a user 9 to insert the spindle 4 into the other spindle receptacle 1*b*, the user 9 can easily set up the spindle 4 without stretching out both arms, as is required by the related art. And after the end 4*a* of the spindle 4 has been inserted into the spindle receptacle 1*a*, half of the total weight of the spindle 4 and the paper roll is supported by the spindle receptacle 1*a*, and the load imposed on the user 9 is reduced. Further, since the other end 4*b* of the spindle 4 can be inserted into the other spindle receptacle 1*b* only pivoting on the support point 12 of the rotatable spindle receptacle 1*a* as the fulcrum, it is extremely easy to replace a paper roll.

The paper feeding path in this embodiment is extended obliquely. However, it may be extended perpendicularly, and with this path also, while standing in front of the printer the user 9 can replace the heavy paper roll 3 without bending at the waist or moving around to the back of the printer. Further, the user 9, from the front of the printer, can easily load large sheets of the stiff carton 21 onto the paper feeding unit without bending at the waist.

The rotation of the rotatable spindle receptacle 1*a* to the front of the large printer is limited to an angle ranging from 20 to 50 degrees, preferably one ranging from 30 to 40 degrees. Thus, the end 4*a* of the spindle 4 can be loaded from the front of the printer at an appropriate angle whereat a large work space depth is not required. Further, when to change a paper roll 3 a spindle 4 is removed from the spindle receptacles 1*a* and 1*b*, the spindle receptacle 1*a* is automatically rotated to the front by a spring 40 and positioned at an appropriate angle. As a result, the direction of the spindle receptacle 1*a* need not be manually adjusted to facilitate the insertion of the end 4*a* of a spindle 4 when a new paper roll 3 is being loaded.

Since two pairs of the spindle receptacles are provided, and are obliquely aligned vertically, the upper spindle being located to the rear, when the paper in one roll 3 is exhausted, it can immediately be replaced by the other one. And if the paper roll 3 on the upper spindle 4 is used first, by switching from the upper paper roll 4 to the lower paper roll 5, printing can continue while the upper paper roll is being replaced.

The stopper 16 engages the engagement portion 15 when the end 4*a* of a spindle 4 is inserted into the spindle receptacle 1*a*, so that the spindle 4 will not be removed from the spindle receptacle 1*a* by mistake during the replacement of a paper roll 3. In addition to this original function, since by glancing at one end of the spindle 4 a user 9 can determine which end is to be inserted into the spindle receptacle 1*a*, the insertion of the incorrect end can be avoided.

What is claimed is:

1. A large printer using at least one roll of paper comprising:

at least one pair of spindle receptacles which hold both ends of an elongated spindle on which a paper roll is mounted, wherein each of the spindle receptacles has an opening opened to a first direction perpendicular to an axis of the spindle, through which each of the both ends of the spindle is inserted; and wherein at least one of the pair of the spindle receptacles is pivotable in a second direction different from the first direction.

2. The large printer as set forth in claim 1, wherein the rotation of the rotatable spindle receptacle toward the front of the printer is limited to an angle ranging from 20 to 50 degrees.

3. The large printer as set forth in claim 1, wherein at least two pairs of the spindle receptacles are arranged obliquely with each other in the vertical direction.

4. The large printer as set forth in claim 1, wherein a stopper is formed on one end of the spindle, and an engagement portion with which the stopper is engaged is formed in the rotatable spindle receptacle.

5. The large printer as set forth in claim 4, wherein the end of the spindle at which the stopper is formed differs in appearance from the other end for preventing the insertion of the wrong end of the spindle.

6. The large printer as set forth in claim 1, wherein the rotatable spindle receptacle is so urged by a spring as to rotate automatically toward a front of the printer for a rotation limit thereof when the spindle is removed.

7. The large printer as set forth in claim 1, wherein the spindle receptacle is horizontally pivotable.

8. The large printer as set forth in claim 1, wherein one end of the spindle situates outside of one of the spindle receptacles in the second direction when the other one of the spindle receptacle holding the other end of the spindle is pivoted to a pivoting limit thereof.

9. The large printer as set forth in claim 1, wherein a position of the at least one roll of paper does not shift in a longitudinal direction relative to the elongated spindle during insertion or removal of the ends of the elongated spindle.

10. A large printer for printing on paper supplied from a paper roll, comprising:

an elongative member for supporting the paper roll; and a pair of support members for supporting both ends of the elongative member, wherein each of the support members has an opening opened to a first direction perpendicular to an axis of the elongative member, through which each of the both ends of the elongative member is inserted; and wherein at least one of the pair of the support members is pivotable in a second direction different from the first direction.

11. The large printer as set forth in claim 10, wherein the rotation of the rotatable support member toward the front of the printer is limited to an angle ranging from 20 to 50 degrees.

12. The large printer as set forth in claim 10, wherein at least two pairs of the spindle receptacles are arranged obliquely with each other in the vertical direction.

13. The large printer as set forth in claim 10, wherein a stopper is formed on one end of the spindle, and an engagement portion with which the stopper is engaged is formed in the rotatable spindle receptacle.

14. The large printer as set forth in claim 13, wherein the end of the spindle at which the stopper is formed differs in appearance from the other end for preventing the insertion of the wrong end of the spindle.

15. The large printer as set forth in claim 10, wherein the rotatable support member is so urged by a spring as to rotate automatically toward a front of the printer for a rotation limit thereof when the elongative member is removed.

16. The large printer as set forth in claim 10, wherein the support member is horizontally pivotable.

17. The large printer as set forth in claim 10, wherein one end of the elongative member situates outside of one of the support members in the second direction when the other one of the support members holding the other end of the elongative member is pivoted to a pivoting limit thereof.

18. The large printer as set forth in claim 10, wherein a position of the paper roll does not shift in a longitudinal direction relative to the elongated member during insertion or removal of the ends of the elongated member.

* * * * *